US010487518B2

(12) United States Patent
Anzalone, Jr.

(10) Patent No.: US 10,487,518 B2
(45) Date of Patent: Nov. 26, 2019

(54) FLOOR CORNER GUARD APPARATUS AND METHOD

(71) Applicant: Frank Anzalone, Jr., Hammond, LA (US)

(72) Inventor: Frank Anzalone, Jr., Hammond, LA (US)

(73) Assignee: Sanitary Corners & Bases, LLC, Hammond, LA (US)

( * ) Notice: Subject to any disclaimer, the term of this patent is extended or adjusted under 35 U.S.C. 154(b) by 0 days.

(21) Appl. No.: 16/015,479

(22) Filed: Jun. 22, 2018

(65) Prior Publication Data

US 2018/0371766 A1 Dec. 27, 2018

Related U.S. Application Data

(60) Provisional application No. 62/524,953, filed on Jun. 26, 2017.

(51) Int. Cl.
*E04F 19/04* (2006.01)
*E04F 19/06* (2006.01)

(52) U.S. Cl.
CPC ..... *E04F 19/0486* (2013.01); *E04F 19/045* (2013.01); *E04F 19/0477* (2013.01); *E04F 19/061* (2013.01)

(58) Field of Classification Search
CPC . E04F 19/0486; E04F 19/045; E04F 19/0477; E04F 19/061
See application file for complete search history.

(56) References Cited

U.S. PATENT DOCUMENTS 2,825,942 A * 3/1958 Potvin ..... E04F 19/0495 52/287.1
3,222,837 A * 12/1965 Daley ..... A47K 3/008 52/250

(Continued)

FOREIGN PATENT DOCUMENTS

CH 340992 A * 9/1959 ..... E04F 19/04
DE 202008016631 U1 3/2009
ES 2204283 A1 4/2004

OTHER PUBLICATIONS

International Search Report and Written Opinion for PCT/US2018/039367 (19 pages). (Year: 2018).*

*Primary Examiner* — Rodney Mintz
(74) *Attorney, Agent, or Firm* — Norton IP Law Firm; Taylor M. Norton

(57) ABSTRACT

A floor cover guard for protection of a corner formed by a pair of adjoining walls and a floor against debris accumulation. The floor corner guard has an elongated wall portion having sufficient vertical dimensions to extend above conventional baseboard, molding, and similar architectural details. A sloping base extends from the wall portion, downwardly and forwardly at an angle of between 25 and 75 degrees in relation to a vertical axis of the wall member. The wall portion has an upper edge and the base has a tapered forward edge to facilitate sealing engagement of the wall portion and the base with the walls and the floor, respectively. Some embodiments provide for a support brace extending outwardly from the wall portion opposite the base; the support brace is designed to fit under the baseboards, moldings and the like. During cleaning, the curved protector allows for easy removal of debris.

7 Claims, 4 Drawing Sheets

(56) References Cited

U.S. PATENT DOCUMENTS 3,562,981 A * 2/1971 Willfurth ..... E04F 19/04 52/211
3,638,374 A * 2/1972 Harby ..... E04L 32/82 52/100
3,942,295 A * 3/1976 Schacht ..... E04F 19/0495 52/287.1
5,184,445 A * 2/1993 Hoopengardner ..... A47G 27/0456 52/287.1
5,450,698 A * 9/1995 Hoopengardner ..... A47G 27/0456 52/287.1
5,553,431 A 9/1996 Pelosi, Jr. et al.
5,595,041 A * 1/1997 Hoopengardner ..... A47G 27/0456 156/71
6,324,799 B1 * 12/2001 Salvitti ..... E04F 19/045 52/287.1
D529,632 S * 10/2006 Folliard ..... D25/119
7,118,791 B2 * 10/2006 Martel ..... A47K 3/008 428/40.1
7,373,729 B2 5/2008 Gerflor
7,703,249 B2 * 4/2010 Rachak ..... E04F 19/04 52/288.1
7,914,878 B2 * 3/2011 Carnes ..... E04F 19/04 428/167
8,375,663 B2 * 2/2013 Johnston ..... E04B 2/7422 52/287.1
8,936,741 B2 1/2015 Carnes et al.
10,145,125 B2 * 12/2018 O'Brien ..... E04F 19/0477
2005/0011159 A1 * 1/2005 Standal ..... B28B 1/14 52/716.1
2007/0175133 A1 8/2007 Woytowich
2008/0173776 A1 * 7/2008 Beard ..... E04F 19/061 248/220.1
2008/0245006 A1 * 10/2008 Rachak ..... E04F 19/04 52/287.1
2009/0092790 A1 * 4/2009 Carnes ..... E04F 19/04 428/156
2016/0160510 A1 6/2016 O'Brien

* cited by examiner

FLOOR CORNER GUARD APPARATUS AND METHOD

CROSS-REFERENCE TO RELATED APPLICATIONS

This application claims the benefit of my provisional application Ser. No. 62/524,953, filed on Jun. 26, 2017 as covering "Sanitary Corners and Base", the full disclosure of which is incorporated by reference herein and priority of which is hereby claimed.

BACKGROUND OF THE INVENTION

This invention relates to building accessories, and more particularly, to a floor corner guard to be installed in corners of rooms to facilitate cleaning and maintenance of a room.

The corner areas of a wall and floor are commonly known to be trouble areas for debris build-up in buildings. The debris build-up is unsightly and may generate a build-up of bacteria and mold if not properly cleaned. By clearing debris, other issues such as bacteria build-up or mold are mitigated. Corners make a perfect trap for collecting debris due to the often ninety degrees angles they provide, thus limiting the direction from which dirt can be reached and preventing easy cleaning. This issue is further increased by homes, industrial buildings, healthcare facilities, and any other buildings that have overhangs due to drywall sheeting, baseboards, decorative molding, and other design or architectural choices as it reduces the ease of which the corners are cleaned. These overhangs exacerbate the issues involved with cleaning corners by preventing easy access to the corner for a cleaning device while also serving to keep some portion of debris build-up hidden from the cleaner's sight.

Further, wall and floor corners include meeting points of two angles of the floor itself, and these present further difficulties for cleaners by limiting access to debris by two angles: requiring tricky maneuvering of a broom, mop, vacuum, or another cleaning device to truly clean. Therefore, an effective corner guard will not only prevent debris build-up but enable easier and more efficient cleaning of the corner space.

Also, because of the maneuvering of the cleaning device, or frustration of the cleaner, current corner guards' area often subjected to harsh methods of sweeping which over time can damage the integrity of the guard by bending or pushing it away from the area it is supposed to protect. These forces may bend the cover back, may push the cover up the wall, may break through the corner of the cover, or may in some other way cause debris to enter the corner area under the cover. Therefore, care needs to be taken to prevent the failure of the structural integrity of the corner guard while ensuring it stays in place as an effective cover. For instance, previous corner guards are often rounded and of material with a comparatively high friction coefficient. The rounded shape can create issues as debris trapped on the corner guard may generate high friction thus creating thin line of debris being effectively trapped in the rounded corner preventing the escape of the debris. Therefore, it is not practical to merely just round the corners as all problems with the ninety-degree angles of cornering persist with the addition of added friction.

There are some corner guards that were developed to prevent debris build up. However, these systems either do not provide the necessary structural integrity, do not enable easier clean-up of the corner areas, are moved out of place over time, do not achieve a cleaner look, or some combination of the above and are therefore not truly sanitary.

For example, German Patent Application Publication No. 202008016631U1, published on Mar. 12, 2009, relates to a baseboard, and particularly for skirting for providing on the connection piece between a floor panel and an interior trim panel having a fold at its lower end, wherein the baseboard designed this decorative connector and the interior trim panel and the floor board coupled with one another, wherein said baseboard has a fastening ledge portion, an inner cladding board receiving portion, a decorative trim portion and a protrusion, wherein the mounting strip portion is a flat board portion that is disposed above the inner cladding board receiving portion and can be fastened on a flush surface, wherein the inner cladding board receiving portion has a support strip portion for placement of interior trim panels, which protrudes in a horizontal direction from the lower end of the fastening strip portion, and an insertion strip portion which is bent obliquely from the support strip portion upwards and the interior trim panel fixed by the fold at the bottom, the end of the interior trim panels intervenes wherein the moldings portion between the inner cladding board receiving portion and the projection is arranged and designed the connecting piece between the inner trim panel and decorative floor board, and wherein the projection in the horizontal direction from the lower end of the trim portion protrudes.

Spanish Patent Application Publication No. 2204283A1, published on Apr. 16, 2004, relates to a system covering installation cockpits, intended to ensure that the joints between walls and between them and the floor and ceiling as well as the very outer corners caused by columns, resulting fully rounded, looking eliminated edges and connection joints, which enables to make a comfortable and effective cleaning, while avoiding the accumulation of dirt and germs, all based on using a curved pieces which are arranged on the dihedral internal corners and edges on whose pieces are directly fixed the coating formed preferably by PVC sheets or similar material, provided it permits the bonding or welding between the different parts constituting the coating itself. The system is designed for use primarily in premises and/or habitat in which a neat hygiene and/or asepsis is required, such as so-called "clean", such as operating rooms in hospitals, certain laboratories, vivarium areas, etc.

U.S. Pat. No. 5,553,431 for a "Cove Base with Antimicrobial Agent and Method for Installing the Same" issued on Sep. 10, 1996 to inventor Frank Pelosi, Jr. et al., discloses a cove base that is made from a relatively thin extruded vinyl and has a height dimension which is substantially greater than the thickness. Although the cove base is used as a top set base and covers imperfections in the outer edges of floor tiles or the like, it has the appearance of a straight base in that it does not include a rounded toe. The cove base is wedge shaped in that it is thinner at the top and gradually thickens toward the bottom while the front surface remains substantially planar. A flexible projection which is a continuation of the front surface extends slightly downwardly and conforms to any high or low spots that may be in the flooring. This projection also defines a space behind the projection and beneath the remaining parts of the cove base which may be used to contain a foam strip or caulking material. The cove base, the foam strip, and/or the caulking material may include an antimicrobial agent therein.

U.S. Pat. No. 8,936,741 for a "Grooved, Corner-Ready Wall Base" issued on Jan. 20, 2015 to assignee Burke Industries, Inc., provides for a resilient wall base member manufactured with pre-scored grooves to allow relatively short, straight lengths to be used for both flat walls and wall corner junctures without on-site scoring operations or equipment. The lengths can either be pre-cut during manufacturing to convenient lengths or can be cut after manufacturing from coils.

U.S. Pat. No. 3,562,981 for an "Inverted Base" issued on Feb. 16, 1971 to inventor Erich Willfurth, discloses an inverted base such that when applied in position at the base of a wall and at floor level, it will be wholly disposed inwardly of the surface of the wall. The inverted base is formed of a thin, self-sustaining, yet sufficiently flexible metal and may be of any desired reentrant configuration, and is provided along its upper and lower side portions with lips each carrying a row of projecting teeth. The lips are designed to respectively engage the wall and floor with the teeth to be driven thereinto. The wall is generally formed of panels of any suitable material secured to studs. In the application of the inverted base the lower horizontal edge portion of the wall panel is beveled with the terminal edge spaced a distance above the floor surface thus providing a reentrant space to receive the inverted base. If desired, should a greater reentrant depth be desired a portion of the wall studs or beams may be cut out to accommodate the inverted base at a greater reentrant depth. The reentrant formation of the inverted base permits a variety of uses thereof as in doors and window frames, adjacent stair treads so to house an electric light, as a base opening housing fluorescent lights, and as a base opening receiving casings of baseboard heaters. In lieu of utilizing a metal inverted base, the floor surface may be covered with a flexible floor covering such as linoleum that is brought up along its end side portions to provide a base construction.

U.S. Patent Application Publication No. 2016/0160510 for "Cove Base Molding Systems and Methods," as published on Jun. 9, 2016 and listing inventor Christopher J. O'Brien, provides a cove base molding strip that includes a body comprising a planar portion having a front surface and a rear surface and a curved portion having a concave surface continuous with the front surface and a convex surface continuous with the rear surface. The rear surface includes at least a first channel. A cove anchor projects from the convex surface, and the intersection of the front surface and the rear surface define a rounded tip that projects from the planar portion. More specifically, the planar portion includes a front surface and a rear surface that intersect to define a rounded or radiused tip at an upper end of the body. The rounded tip projects rearward of the rear surface. The rounded tip extends beyond the rear surface in the resting position so that movement of the rear surface into the installed position causes the rounded tip to deform slightly which, when constructed from an elastic material, causes the rounded tip to press firmly against the wall, creating a seal that acts as a moisture barrier. The curved shape of the rounded tip provides a smaller surface area of the upper end of the cove base molding strip, thereby minimizing the amount of dust that can accumulate along the top of the cove base molding strip. The seal created by the rounded tip and the wall also eliminates the need for caulking this junction.

U.S. Patent Application Publication No. 2007/0175133 entitled "Floor Corner Guard" published on Aug. 2, 2007 by inventors Mark S. Woytowich, discloses a corner guard made for installation in floor corners. The corner guard may be made of flexible material and have three seating surfaces and a front face. Two of the seating surfaces are positioned adjacent to intersecting wall sections, and the third surface is positioned adjacent to the floor. The edge of the guard adjacent the floor will often be radiused to facilitate cleaning. Once installed the guard improves the overall cleanliness and appearance of a room by preventing dirt or debris from accumulating in difficult to clean corners.

U.S. Pat. No. 7,373,729 for a "Device and Method for Laying Floor Coverings in Corner Areas Where Floors and Walls Meet" issued on May 20, 2008 to assignee Gerflor, discloses a device for laying floor and wall coverings in reentrant corners, and comprises an independent insert obtained from the same material as the flooring and having two dimensions before laying and being defined in three dimensions after laying and having, when flat, a geometrical configuration of irregular lines so that, after laying, said insert has a regular parallelepiped geometrical configuration. The insert includes, three triangular areas, of which two of the bases are part of the peripheral outline of the insert and the third inner base makes it possible, by consecutive juxtaposition, to obtain a central triangular part sloping, after laying, and situated in a forward plane away from the corner part where the successive walls and the floor meet.

While the previous approaches may be beneficial in certain circumstances, there exists a need for an effective system for preventing debris build-up while enabling easier cleanup of the floor, in a manner that is both able to fit unguarded corners and retrofittable over existing corner guards.

SUMMARY OF THE INVENTION

This invention provides a sanitary floor corner guard apparatus to be used to protect debris build up in corners and to effect easier cleaning of corners.

It is, therefore, an objective of the present invention to provide a device for covering floor corners at the intersection of wall bottoms and the floor.

It is further an objective of the present invention to enable easier clean-up of the remaining floor corner area by creating a sloping extension that reaches the floor.

It is further an objective of the present invention to provide a room corner protection device that retains its structural integrity and does not bend or break due to harsh brushing or cleaning methods.

It is further an objective of the present invention to provide a room corner protection device that remains in place over the floor corner by adhering to the wall adjacent to the floor corner.

It is further an objective of the present invention to protect the adherence of the cover to the wall by encompassing the use of support strut that prevents both horizontal and vertical movement being induced by cleaning methods in the corner.

This invention provides a sanitary floor corner guard to be used to prevent the build-up of dirt, dust, and bacteria in the corner areas, where a floor meets a wall to form a ninety-degree corner, without losing its effectiveness or structural integrity due to harsh sweeping, mopping, or other common cleaning methods. The corner guard of the present invention, covers and closes off the corner area of the walls and floor from debris accumulation. The corner guard of the present invention can be installed over current house wall and flooring or can be retrofitted to fit over existing corner guards, baseboards, and molding.

The present invention provides for a floor corner guard that has a wall portion which adheres to wall adjacent the floor, a sloping portion protruding forward and down from the wall portion to contact the floor at an angle; and a support brace, or strut where the sloping portion meets the wall portion, preferably directly under or over an overhang, thus preventing the sanitary floor cover from sliding up or bending inward. The system is sanitary because it prevents the buildup of debris in the corner which resists bacteria build up, makes the corners easier to clean by reducing the required effort, and maintains structural integrity enabling clean condition over the lifetime of the product. This system is further retrofittable over existing cover guards.

DETAILED DESCRIPTION OF THE INVENTION

Figure 1:
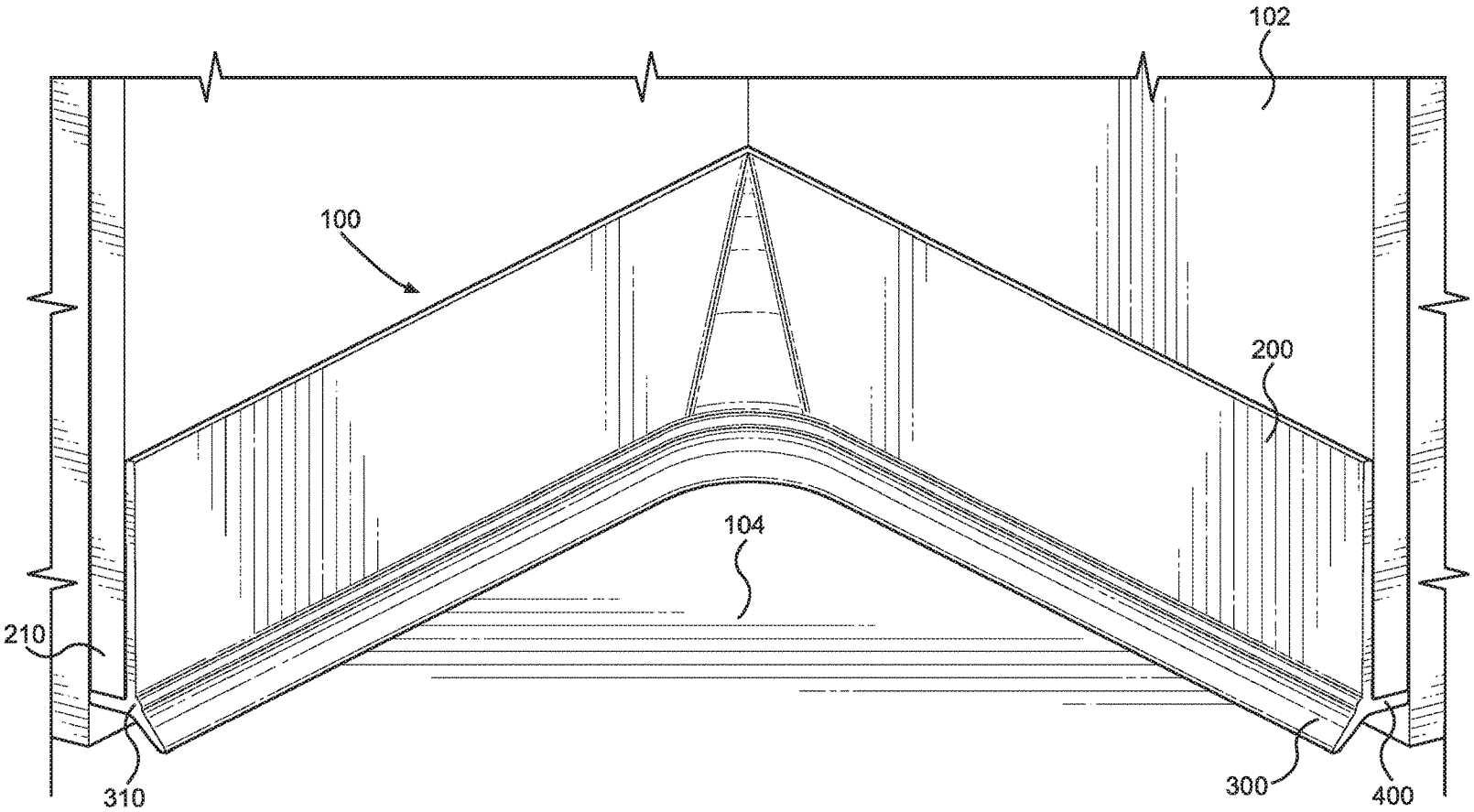
FIG. 1 is a perspective view of the corner guard fitted onto a corner of a wall.
Figure 2:
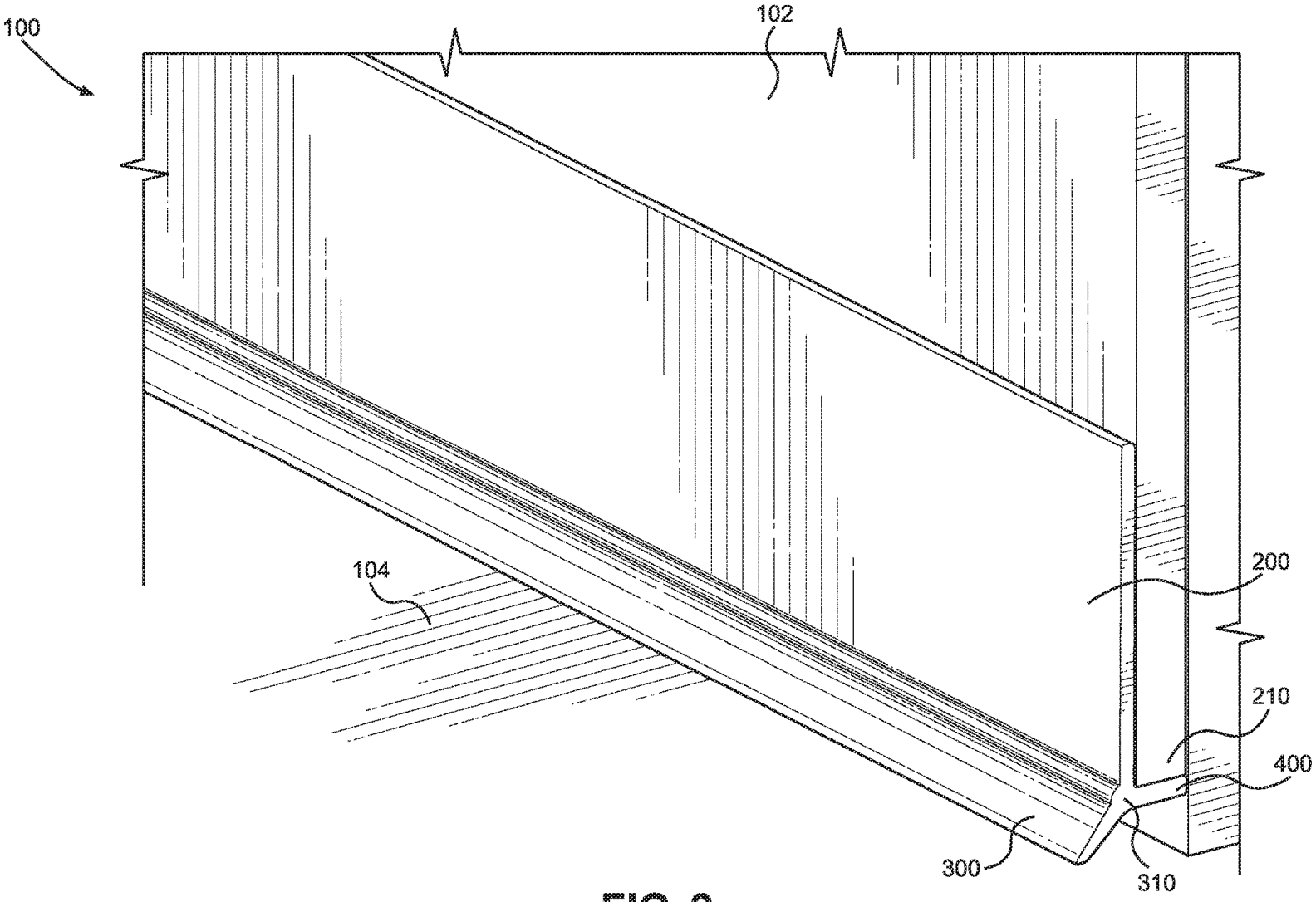
FIG. 2 is a perspective view of the floor guard fitted along a straight edge of a wall.
Figure 3:
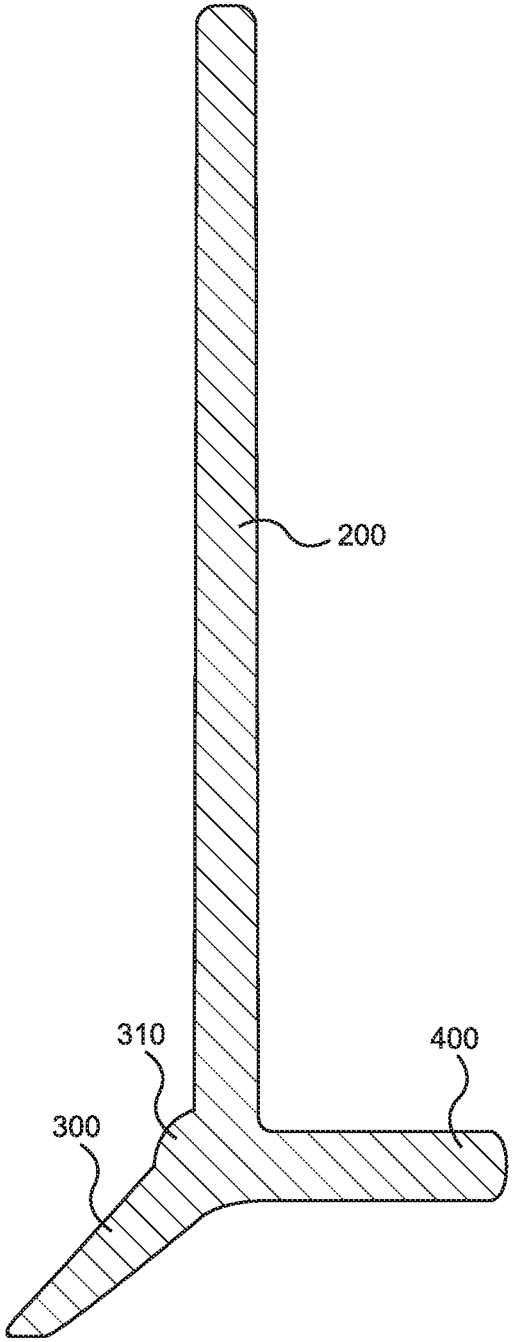
FIG. 3 is a cross-sectional view of the floor corner guard.
Figure 4:
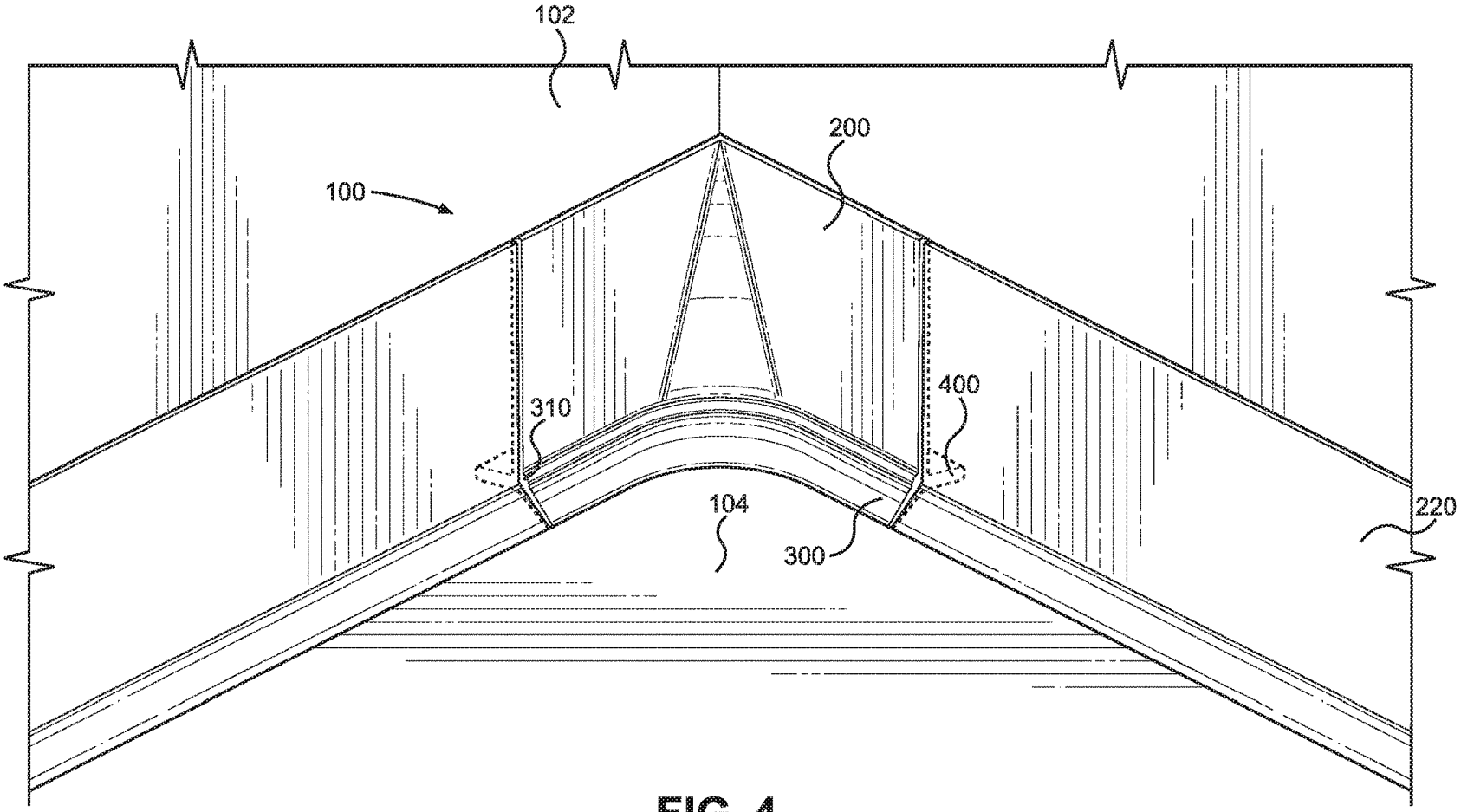
FIG. 4 is a perspective view of the floor cover guard retrofitted into a corner over an existing floor cover.

Referring to FIGS. 1, 2, and 4 generally, the figures depict a perspective view of the floor corner guard 100 of the present invention, while FIG. 3 depicts a cross-sectional view of the floor cover guard 100 of the present invention. The preferred embodiment of the sanitary floor cover guard 100 comprises three main portions: a substantially planar elongated wall member 200 which adheres to the wall 102 just above the corner formed by the wall 102 meeting the floor 104, a forwardly sloping base 300 creating a uniform slope from wall 102 to floor 104, and a rearwardly extending support brace 400 which may fit under any potential overhang to further prevent movement of the sanitary floor corner guard 100 due to cleaning. This floor corner guard 100 fits both straight portions of wall 102 and floor 102 as well as corners formed at, but not limited to, edges of the room. In one aspect of the invention, the wall member 200, the base 300, and the support brace 400 are formed as a unitary body.

The elongated wall member 200 as depicted in FIGS. 1, 2, and 4 is designed to allow sufficient adherence to the wall 102 to prevent movement of the floor corner guard 100. In one aspect of the invention, the wall member 200 is made from a polymer material being smooth to enable cleanup and sturdy enough to withstand multiple cleanings. In the preferred embodiment of the present invention, the top of the wall member 200 has a tapered configuration so that the wall member 200 sealingly engages adjoining walls along the upper edge of the corner guard and prevents accumulation of debris on top of the corner guard. It is envisioned that in some embodiments, the upper edge will be high enough to prevent a cleaner from easily transferring dirt from the floor to the top of the wall member 200. The wall member 200 has pre-determined vertical dimensions sufficient to extend above conventional baseboards, molding, and other architectural enhancements secured to the wall 102 at the floor level.

As depicted in FIG. 4, the elongated wall member 200 may be adhered to a previously installed floor corner guard, floor molding, or baseboard 220, as opposed to directly to the wall 102. When the floor corner guard 100 is installed over a previously installed floor corner guard 210, the support brace 400 may reach through the installed floor corner guard 220 to reach the wall 102. When placed in corners of rooms, the elongated wall member 200 is longer at the bottom portion of its sheet than at the top portion of its sheet as shown in FIG. 1 and FIG. 4. The wall member 200 is formed from a somewhat flexible material allowing it to be slightly bet when fitting into a corner. The wall member can be secured to the wall 102 by a suitable adhesive applied to the back surface of the wall member, or by other suitable mechanical means.

The sloping base 300 as depicted in FIGS. 1 through 4 generally, slopes at an acute angle downward and outward from the vertical axis of the elongated wall member 200 starting at a point at one-fourth of an inch to two inches off the floor 104 and touching the floor 104 at its front tapered edge. In one aspect of the invention the base 300 extends outwardly from the wall member 200 at an angle of between twenty-five to seventy-degrees. The base 300 extends along entire length of the bottom edge of the wall member 200.

If the wall includes an overhanging portion 220, a preferred embodiment of the invention will start the slope at the height of the overhang 210. The sloping base 300 continues from its upper edge, which is unitary connected to a bottom edge of the wall member 200, until it reaches the floor 104; the tapered bottom edge of the sloping base 300 contacts the floor 104, sealing the space between the corner guard 100 and the floor 104 to prevent debris from being moved under the edge of the sloping base 300. In the preferred embodiment of the present invention, the slope of the sloping wall member 200 is uniform and thus does not form a friction trench. However, in alternate embodiments, the elongated sloping base 300 may be bent and of sufficiently smooth and frictionless material to allow a curve in the base 300.

The supporting brace 400 as depicted in FIG. 3 is a brace 400 which typically sits under an overhang 220 such as created by drywall or over an overhang created by baseboards. The supporting brace 400 reaches rearwardly from the elongated wall member 200 to the wall 102 creating a brace 400 that takes advantage of the overhang 210 to provide structural support to the floor corner guard 100. Support is generated in two ways: support is generated in a manner preventing inward bending, and support is generated which further prevents the floor corner guard 100 from sliding up or down the wall 102. Any space created by an overhang 210 may be sealed off at the ends of the floor cover guard 100 by a continuation portion of base 300 and the support brace 400.

A rounded band, or bead, 310 extends along substantially entire length of the corner guard 100, between the bottom edge of the wall member 200 and the top edge of the base 300. The band 310 is unitary formed with the wall member 200 and the base member 300; it extends outwardly and forwardly from the bottom edge of the wall member 200 at a location opposite the brace 400. The band 310 is designed to further reinforce the bottom of the wall member 200. The band 310 has an outwardly convex configuration.

In alternate embodiments of the invention, the apparatus may be inverted to apply to other ledges such as those found on or created by windows, baseboards, or trim. In such cases as inversion the sloping wall member 200 will slope upwards or sideways, and as required by trim, also slope outwards or inwards. The sloping wall member 200 of the present invention will always maintain the same angles of twenty-five to seventy degrees.

In use, the floor corner guard 100 is positioned in the corner and may be slightly flexed or bent to replace the angular configuration of the corner in the room with a curved line. The floor corner is thoroughly cleaned so that no debris remains behind the corner guard 100. The wall member 200 is adhesively secured to adjoining walls just above the floor 104, making sure that the upper edge of the wall member 200 and the forward edge of the base 300 seal against the adjoining walls and the floor, respectively.

The base 300 is curved following the curvature of the wall member 200 and covers a sharp corner at the intersection of the floor with two angularly-meeting adjoining walls. The support brace 400 follows the curvature of the base member 300 and the wall member 200. The forward edge of the base 300 seals against the floor 104, preventing dust and debris from penetrating under the floor guard. The brace 400 extends under an existing baseboard or molding, reinforcing the base 300.

Many changes and modifications can be made in the sanitary corner guard according to the present invention without departing from the spirit thereof. I, therefore, pray that my rights to the present invention be limited only by the scope of the appended claims.

I claim:

1. A floor corner guard apparatus, comprising:

an elongated flexible planar wall member having predetermined vertical dimensions configured to extend from a floor to a predetermined distance up two adjoining walls, the wall member being configured to securely engage the adjoining walls in a location where the adjoining walls meet the floor;

a base member unitary connected to the wall member and extending along entire length of the wall member, the base member extending forwardly and downwardly from a bottom edge of the wall member at an angle in relation to a vertical axis of the wall member;

a supporting brace member unitary connected to a bottom edge of the wall member and extending rearwardly from the wall member; and a reinforcing band unitary formed with, and extending outwardly at an intersection between the wall member and the base member.

2. The apparatus of claim 1, wherein the reinforcing band has an outwardly convex configuration.

3. The apparatus of claim 1, wherein the supporting brace member is unitary connected to the wall member and extends outwardly from the wall member in a direction opposite to the base member.

4. The apparatus of claim 3, wherein the supporting brace member extends from the wall member at a location opposite to the reinforcing band.

5. A method of preventing accumulation of debris in a room, at an intersection of two adjoining walls and a floor, the method comprising the steps:

providing a floor corner guard comprising an elongated flexible planar wall member having vertical dimensions configured to extend from a floor to a pre-determined distance up two adjoining walls;

providing a base member unitary connected to the wall member and extending along entire length of the wall member, the base member extending forwardly and downwardly from a bottom edge of the wall member at an angle in relation to a vertical axis of the wall member;

providing a supporting brace member unitary connected to a bottom edge of the wall member and extending rearwardly from the wall member;

providing an outwardly convex reinforcing band unitary formed with, and extending outwardly at an intersection between the wall member and the base member; and positioning the wall member in contact with adjoining walls at the intersection of the adjoining walls and the floor, such that an upper edge of the wall member and the base member sealingly engage the adjoining walls and the floor respectively, while forming a curved corner protector, and while the supporting base member extends rearwardly from the wall member.

6. The method of claim 5, wherein the supporting brace member extends outwardly from the wall member in a direction opposite to the base member.

7. The method of claim 6, wherein the supporting brace member extends from the wall member at a location opposite to the reinforcing band.

* * * * *